US005283402A

United States Patent [19]

Green

[11] Patent Number: 5,283,402

[45] Date of Patent: Feb. 1, 1994

[54] ACCELERATION SENSOR WITH MAGNETIC OPERATED REED SWITCH

[75] Inventor: Terence W. Green, Norfolk, England

[73] Assignee: Hamlin Incorporated, Lake Mills, Wis.

[21] Appl. No.: 997,761

[22] Filed: Dec. 24, 1992

[30] Foreign Application Priority Data

Jan. 17, 1992 [GB] United Kingdom ..... 9200952

[51] Int. Cl.[5] ..... H01H 35/14

[52] U.S. Cl. ..... 200/61.45 R; 200/61.45 M; 200/61.52; 200/61.48; 335/205

[58] Field of Search ..... 200/61.45 R, 61.45 M, 200/61.52, 61.53, 81.9 M, 82 E, 84 C; 335/205, 206

[56] References Cited

U.S. PATENT DOCUMENTS

| | | | |
|---|---|---|---|
| 3,421,124 | 1/1969 | Kidd | 335/205 |
| 3,749,864 | 7/1973 | Tice | 200/81.9 M |
| 3,927,286 | 12/1975 | Fohl | 200/61.45 R |
| 3,967,079 | 6/1976 | Sasaya et al. | 200/61.45 R |
| 4,016,535 | 4/1977 | Dimlocker | 340/52 H |
| 4,074,095 | 2/1978 | Romanowski | 200/81.9 M |
| 4,609,796 | 9/1986 | Bergsma | 200/84 C |
| 4,663,540 | 5/1987 | Ferrante | 307/118 |
| 4,705,922 | 11/1987 | Seeger et al. | 200/61.45 M |
| 4,820,888 | 4/1989 | Shields | 200/61.45 M |
| 4,916,266 | 4/1990 | Tetrault | 200/61.45 R |
| 4,982,684 | 1/1991 | Rubey | 116/203 |
| 4,987,276 | 1/1991 | Bader et al. | 200/61.45 M |
| 5,149,926 | 9/1992 | Ono | 200/61.45 M |
| 5,153,394 | 10/1992 | Abendroth et al. | 200/61.45 R X |
| 5,165,717 | 11/1992 | Tanaka | 280/734 |

FOREIGN PATENT DOCUMENTS

| | | |
|---|---|---|
| 1440771 | 6/1976 | United Kingdom . |
| 2020911 | 11/1979 | United Kingdom . |

*Primary Examiner*—J. R. Scott
*Attorney, Agent, or Firm*—Lathrop & Clark

[57] ABSTRACT

A switch assembly has a magnet (26) mounted for in the vicinity of a reed switch (20). A weight (29) is movable in a direction generally perpendicular to the magnet (26), and is connected thereto by a mechanism (16;38,39,40;44) which translates the movement of the weight to movement of the magnet. The magnet (26) and reed switch (20) are configured so that the reed switch actuates on movement of the magnet.

21 Claims, 6 Drawing Sheets

ACCELERATION SENSOR WITH MAGNETIC OPERATED REED SWITCH

FIELD OF THE INVENTION

This invention relates to a switch assembly, in particular but not exclusively of the kind which operates in response to tilting of the switch, i.e. a tilt switch, or of the kind which is responsive to the application of an impulse to the switch (i.e. a shock sensor).

BACKGROUND OF THE INVENTION

Previously, such devices have relied for their operation upon the movement of a pool of mercury to open or close the contacts of the switch. Numerous arrangements of such switches have been devised. However, all tilt switches and shock sensors which employ a mercury contact are disadvantageous because mercury is an extremely toxic material. Therefore, it is necessary for people manufacturing tilt switches and shock sensors to take precautions against poisoning by inhalation of mercury vapors, ingestion of mercury or touching of mercury. Additionally, the casings of tilt mercury switches and shock sensors must be strongly made and well sealed so that there is no danger of mercury escaping when the switch or sensor is damaged.

A further disadvantage of mercury tilt switches and shock sensors is that the mercury is difficult to dispose of safely when the switches and sensors are scrapped.

SUMMARY OF THE INVENTION

According to the invention, there is provided a switch assembly comprising a support; a reed switch mounted in the support; a source of magnetism movable between a first position which causes the blades of the reed switch to adopt one configuration and a second position which causes the blades to adopt a further configuration; a weight moveable in a direction generally perpendicular to the direction of the source; and means for interconnecting the weight and source of magnetism whereby movement of the weight relative to the support causes movement of the source between its two positions to actuate the reed switch. The phrase "actuate the reed switch" is intended to embrace operation of the reed switch by closing of the reed blades together which is known as "Form A" operation and also by opening of the reed blades, which latter mode of operation is known as "Form B" operation.

Preferably, the source of magnetism is a permanent magnet.

An advantage of this arrangement is that the switch assembly can be manufactured as either a tilt switch or a shock sensor without the need for mercury. Furthermore, the sensitivity of the switch assembly is easily adjusted, for example by adjusting the mass of the weight, or the material of the magnet.

Preferably, the support includes a hollow housing having a base, the reed switch extending upwardly of the base on a sub-frame within the housing, and the magnet being movable along the sub-frame. This has been found to be a particularly efficient arrangement for a tilt switch.

Preferably, the sub-frame includes means for constraining movement of the magnet to the region of the sub-frame. A switch assembly including this feature may be inverted without the magnet falling off the sub-frame.

Conveniently, the magnet surrounds the reed switch. This feature makes operation of the switch assembly more reliable.

It is preferable that the means for interconnecting comprises a hollow cup having an aperture formed in the base thereof, the cup being disposed within the housing with its base adjacent the base of the housing, the magnet lying on the base of the cup, and the aperture surrounding the sub-frame, and wherein the weight causes tilting of the cup which in turn raises the magnet up the sub-frame on the base of the cup to actuate the reed switch.

In a particularly preferred embodiment, the base of the housing has formed therein a recess for receiving one end of the cup, the upwardly extending walls of the recess being outwardly inclined to permit tilting of the cup. This feature ensures that the cup is correctly located relative to the sub-frame, yet permits tilting of the cup to take place.

Preferably, the weight is formed as a cap for the upper end of the cup. The construction of a switch assembly including this feature is advantageously straightfoward.

Conveniently, the cup tapers towards the base thereof. This feature allows the cup to tilt more readily, and hence permits the switch assembly to be more sensitive.

Preferably, the weight and/or the cup taper towards the upper end thereof. This allows the cup to tilt further when enclosed within a housing without contacting the walls of the housing than if the upper end of the cup/-weight was squared off.

In one embodiment of the invention, the switch assembly is modified in that the magnet is spaced from the base of the cup by a spacer which transmits motion of the base of the cup to the magnet, whereby in the untilted condition of the cup the magnet lies adjacent the blades of the reed switch and when the cup tilts the magnet moves away from the blades to actuate the reed switch. This arrangement permits Form B operation of the switch assembly.

In another embodiment of the invention, the upper end of the cup and/or weight conveniently has formed therein an aperture through which extends at least part of the sub-frame and/or at least part of the reed switch. This feature allows the overall height of the switch assembly to be minimized.

In one embodiment of the invention, the weight is secured to a member having a laterally extending flange which lies on the upper end of the sub-frame and an upwardly directed portion, whereby tilting of the member causes raising of the flange which in turn raises the yoke or cup to move the weight and actuate the reed switch.

In another embodiment of the invention, the assembly conveniently includes a cup having a base and at least one upwardly directed member disposed within the support, the magnet being secured to the upwardly directed member and the weight acting on the base externally of the cup. A preferable feature of this embodiment is that the support includes a base having an upwardly extending pivot member secured thereto, the pivot member being disposed between the base of the support and the base of the cup, the weight being adapted to balance on the pivot member and the weight being secured to the yoke, whereby tilting of the weight on the pivot member causes it to drive the cup upwardly thereby to actuate the reed switch.

Alternatively, the support may include a base and the weight may be formed as a ball capable of rolling on said base, the cup having a downwardly facing, inclined face, the member being disposed between the ball and the base of the cup such that rolling of the ball on tilting of the switch assembly drives the member upwards to move the magnet and actuate the reed switch, means being provided to limit the movement of the member in the direction of rolling of the ball.

Alternatively, the means for interconnecting may be formed as an inverted cup surrounding the ball, the switch assembly including, instead of the inclined face of the means for interconnecting, a base of the support including an inclined face on which the ball is constrained to roll, the inverted cup including an upwardly extending member to which the magnet is connected, the arrangement being such that rolling of the ball on the inclined surface causes raising and lowering of the upwardly extending member, and hence the magnet, whereby the reed switch is activated.

There is provided, in another preferred embodiment of the invention, a support including a generally horizontal platform having formed therein an aperture, the reed switch being disposed below the platform, the weight being formed as a ball capable of rolling on the platform and the mans for interconnecting being formed as an elongate, flexible member which passes through the aperture and which is secured at its ends to the weight and the magnet respectively.

The switch assemblies defined herein above may optionally include a plurality of reed switches arranged to be activated by movement of the sources of magnetism. It is an optional feature that there is provided a plurality of sources of magnetism arranged to actuate each reed switch.

Each source of magnetism may optionally have in excess of two poles.

BRIEF DESCRIPTION OF THE DRAWINGS

There now follows a description of preferred embodiments of the invention, by way of example, with reference being made to the accompanying drawings in which.

DESCRIPTION OF THE PREFERRED EMBODIMENTS

Figure 1:
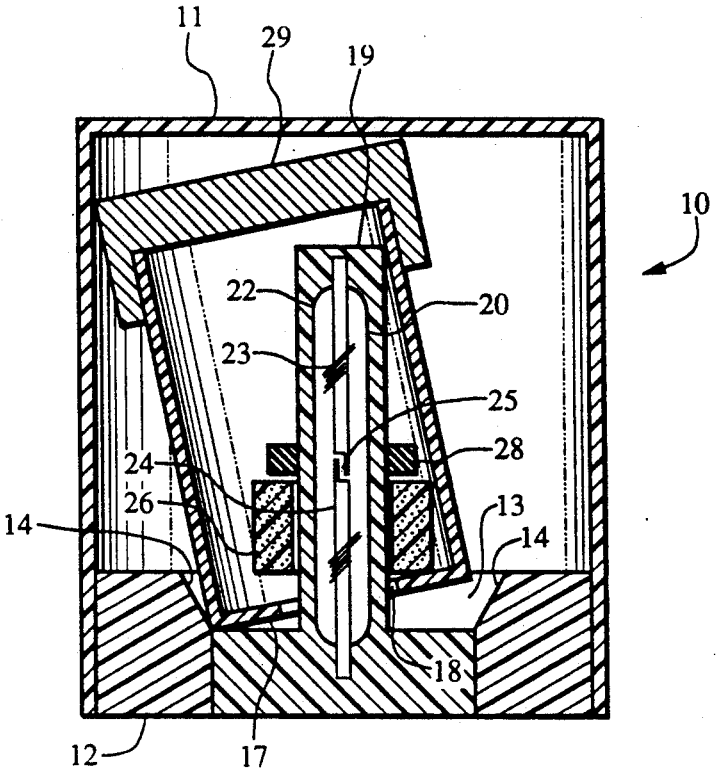
FIG. 1 is a cross-sectional view of a switch assembly according to the invention.

Referring firstly to FIG. 1, there is shown a switch assembly in the form of a tilt switch 10. Tilt switch 10 comprises a support in the form of a hollow, tubular housing 11 and base 12. The upper surface of base 12 has formed therein a central recess 13 the upwardly extending sidewalls 14 of which are inclined to the vertical.

A cylindrical cup 16 having its generally closed end 17 lowermost is disposed in recess 13. Cup 16 is shown tilted to one side in FIG. 1, although it will be understood that cup 16 normally resides in an upright orientation until some movement of the tilt switch 10 causes it to tilt.

The closed end 17 has formed therein a central, circular aperture 18. A vertically extending sub-frame member 19 extends from base 12 upwardly through aperture 18. Sub-frame member 19 has secured therein a conventional reed switch 20 comprising an evacuated glass tube 22 and a pair of reed blades 23, 24 which terminate in the centre of the reed switch at reed contact 25. The other ends of the reed blades 23, 24 pass through the walls of glass tube 22 to form terminals which may be electrically connected, in a manner not shown in FIG. 1, to electrical apparatus in which the switch 10 is installed.

A source of magnetism in the form of annular magnet 26 encircles sub-frame member 19 within cup 16. Magnet 26 is free to travel up and down sub-frame member 19. A collar 28 rigidly secured to sub-frame member 19 limits the extent of travel of magnet 26.

The upper, open end of cup 16 is closed by means of a cap-like weight 29.

It will be apparent that cup 16, when upright, is in a condition of stable equilibrium but when the switch 10 is jolted or tilted, cup 16 will tend to overbalance because of the height of its centre of mass occasioned by weight 29. When cup 16 tilts in this manner, the closed end 17 thereof will rise in an inclined manner relative to the base 12 of the switch assembly 10. Since the magnet 26 is ordinarily in contact with closed end 17, magnet 26 will as a result be driven upwardly along sub-frame member 19, the extent of movement of magnet 26 being limited by collar 28. As magnet 26 moves along sub-frame 22, its magnetic field influences the blades of reed switch 20 either to open or close, depending on the initial position of magnet 26 and the nature of the field lines associated therewith.

In the embodiment shown in FIG. 1, the reed switch is in an open position when the cup is upright, and the reed switch closes when the cup tilts to raise magnet 26.

It will thus be seen that the operation of the tilt switch assembly 10 relies upon the conversion of a primarily lateral movement, the tilting of cup 16, into a movement primarily in the perpendicular direction, i.e. the raising of magnet 26, so that magnet 26 influences a reed switch, reed switch 20, to actuate.

In the tilt switch embodiments shown in FIGS. 2–9, components similarly designated to parts of previously described tilt switches have been called out with similar reference numbers incremented by multiples of 100.

Figure 2:
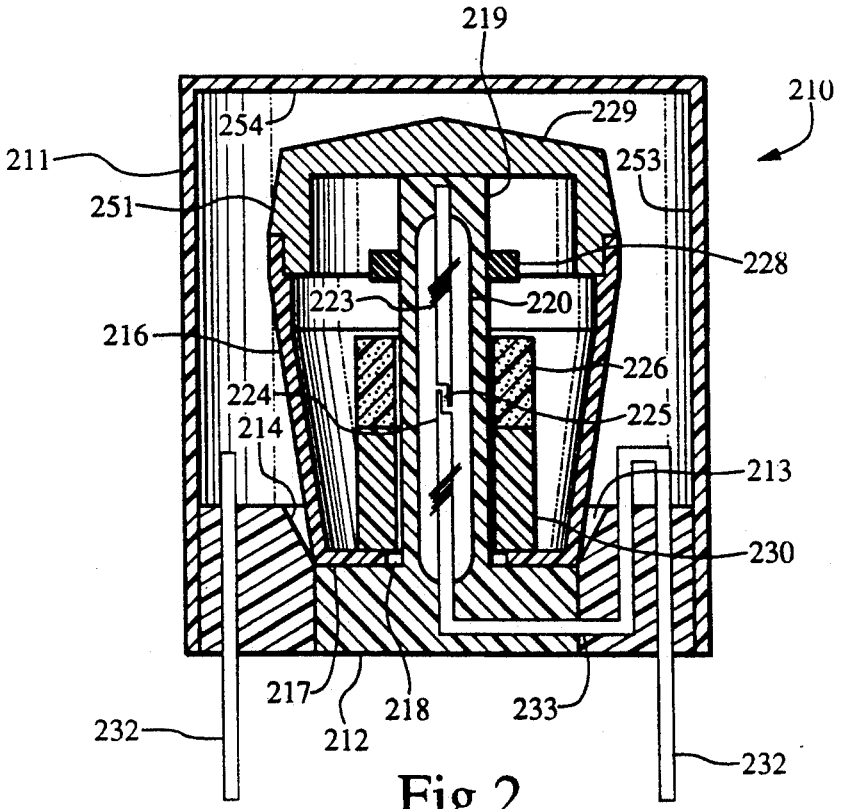
FIG. 2 is a cross-sectional view of a modified form of the switch of FIG. 1.

FIG. 2 shows an alternative embodiment tilt switch 210.

The cup 216 of FIG. 2 tapers towards the lower end thereof, although the base 217 of the cup 216 is flat and normally horizontally disposed as in the embodiment of FIG. 1. The tapering of cup 216 allows the magnet 226 to rise further up sub-frame member 219 before it fouls the cup 216 or weight 229. This feature allows configuration of the switch assembly 210 for "form B" operation. This is achieved by the insertion of a spacer 230 between magnets 226 and base 217 so that, in the untilted condition of the cup 216, the magnet 226 is initially disposed adjacent the reed contact 225. When cup 216 tilts, magnet 226 is raised up sub-frame member 219 towards collar 228, and this causes the reed switch to actuate by opening the reed contact which was initially in a closed configuration. Thus, tilting of the device 210 of FIG. 2 causes an open circuit to arise. This is useful in some applications.

The weight 229 is shaped to allow the cup 216 to tilt further over within housing 211 than is the case in the embodiment 10 of FIG. 1. In particular, the vertically extending side wall 251 of weight 229 tapers inwardly towards the upper surface 252 of the weight, and the upper surface itself is conical, the cone angle being very shallow. It will be understood that when the cup 216 tilts, it will tilt considerably further than does the cup 16 of FIG. 1 before the weight 229 fouls either the side wall 253 or upper end wall 254 of housing 211.

Despite the fact that the magnet 226 rises to a greater maximum height up sub-frame member 219 in the embodiment 210 of FIG. 2, the overall height of the embodiment 210 of FIG. 2 is less than that of FIG. 1 as a result of the design of the cup 216 and the weight 229.

In the embodiment 210 of FIG. 2 there are shown two electrical terminals 232 intended for connection to the terminals of the reed blades 223 and 224. Wiring 233 is shown to illustrate the manner in which one of the terminals 232 is connected to reed blade terminal 224. A similar arrangement can be devised to connect reed blade 223 to the other terminal 232.

Figure 3:
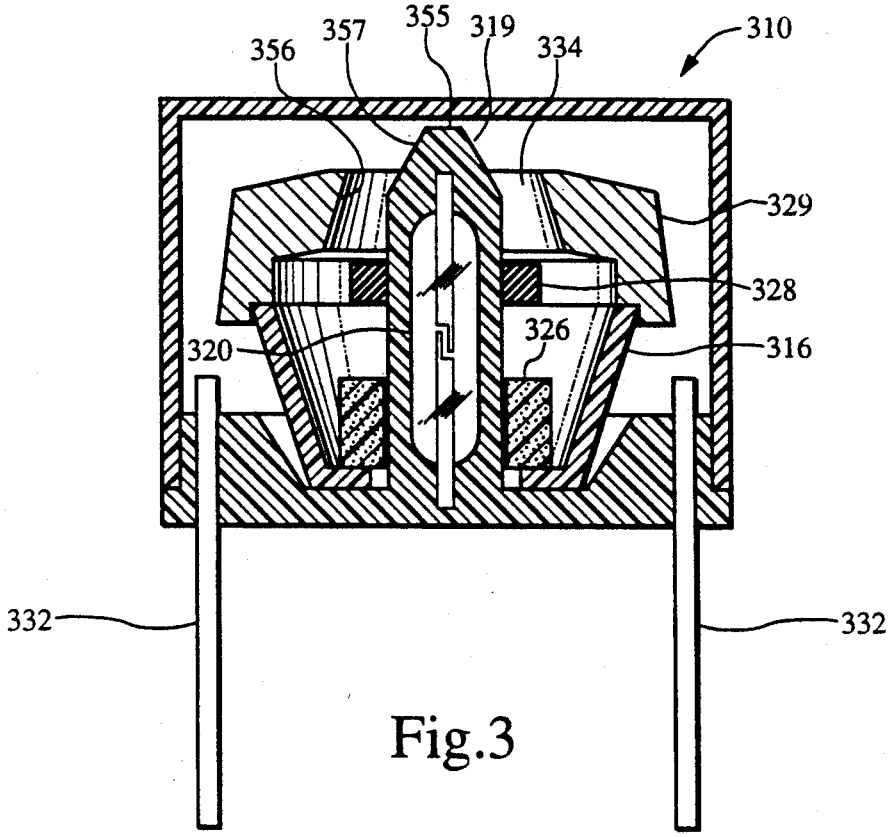
FIG. 3 is a cross-sectional view of a switch assembly according to the invention designed to have a low overall height.
Figure 4:
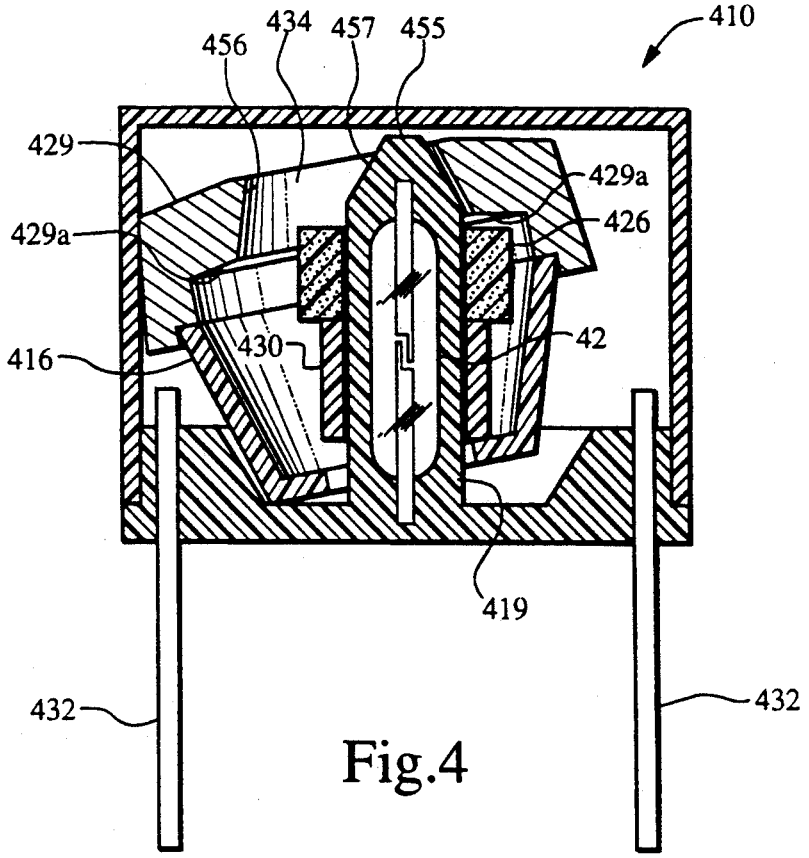
FIG. 4 is a modified form of the switch assembly of FIG. 3 shown in a tilted condition.

FIGS. 3 and 4 show versions 310, 410 of the switch assembly 10 of FIG. 2, modified to reduce the overall height and diameter of the assembly even further. The embodiment 310 of FIG. 3 is configured for Form A operation, whilst the embodiment 410 of FIG. 4 is suitable for Form B operation. In the embodiment 310 of FIG. 3 there are shown two electrical terminals 332 intended for connection to the terminals of the reed blades.

The embodiment 410 of FIG. 4 is shown in the tilted condition.

The primary modification made to the embodiments 310, 410 of FIGS. 3 and 4 is that the cup 316, 416 and weight 329, 429 are squat in comparison with the corresponding components 216, 229 shown in FIG. 2. To accommodate the length of sub-frame member 319, 419 necessary to support the reed switch 320, 420, an aperture 334, 434 is formed centrally in weight 329, 429. The upper end 355, 455 of sub-frame member 319, 419 protrudes through aperture 334, 434. The wall 356, 456 of aperture 334, 434 is chamfered, and the tip 357, 457 of sub-member 319, 419 is correspondingly chamfered so that when cup 316, 416 tilts as shown in FIG. 4 the weight 329, 429 does not foul on sub-frame member 329, 429.

In the embodiment 410 of FIG. 4, the collar 328 which limits upward movement of magnet 426 is absent, and weight 429 is shaped in the region 429*a* to accommodate magnet 426 when cup 416 is in its fully tilted over position as shown in FIG. 4. These measures between them allow reduction in height of the embodiments 310, 410 of FIGS. 3 and 4 as compared with that of FIG. 2 to about half the height of the embodiment 210 of FIG. 2. The applicants have manufactured a version of the embodiment 410 of FIG. 4 the height of which excluding the terminals 432, i.e. the effective height above a circuit board by which the assembly would protrude, is approximately 11.5 mm. The diameter of that version is 15.5 mm, as compared with 18.5 mm in the manufactured sample of the embodiment of FIG. 2.

The embodiments of FIGS. 2, 3 and 4 are the most successful that the applicants have devised, primarily because of their compact configurations and simplicity of assembly. Since there are effectively only three moving parts, cup 16, magnets 26 and, optionally, spacer 230, in addition to the blades of the reed switch 20, operation of the embodiments 10, 210, 310, 410 of FIGS. 1 to 4 is extremely reliable.

FIGS. 5 to 9 show further embodiments 510, 610, 710, 810, 910 of the invention.

Figure 5:
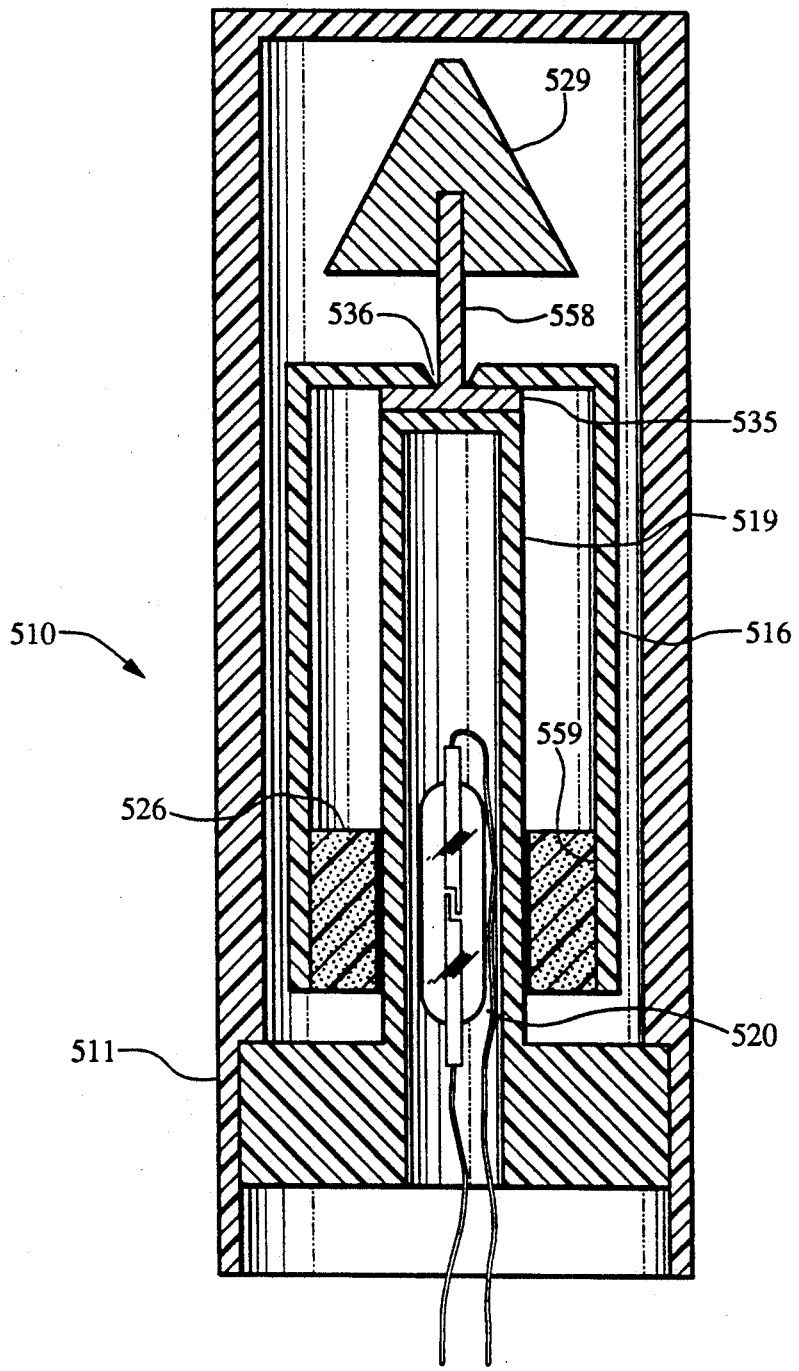
FIGS. 5 to 9 show various alternative forms of tilt switch in accordance with the invention.

In FIG. 5, weight 529 is balanced at the top of sub-frame member 519 by means of a foot 535 secured at the lower end of a shaft 558 extending downwardly from weight 529. It will be appreciated that tilting of weight 529 on sub-frame member 519 will cause foot 535 to rise in an inclined manner. An inverted cup 516 also rests on the upper end of sub-frame member 519, encircling it. Foot 535 is disposed within cup 516 and passes via an aperture 536 formed centrally in the closed end of cup 516 resting on sub-frame member 519 to weight 529.

Magnet 526 is in the embodiment 510 of FIG. 5 an annular magnet secured about the inner wall 559 of the lower end of cup 516, adjacent reed switch 520. However, other magnet configurations could be devised. For example, a series of magnets may be disposed about the end of cup 516 to provide a magnetic field of predetermined shape about reed switch 520.

Figure 6:
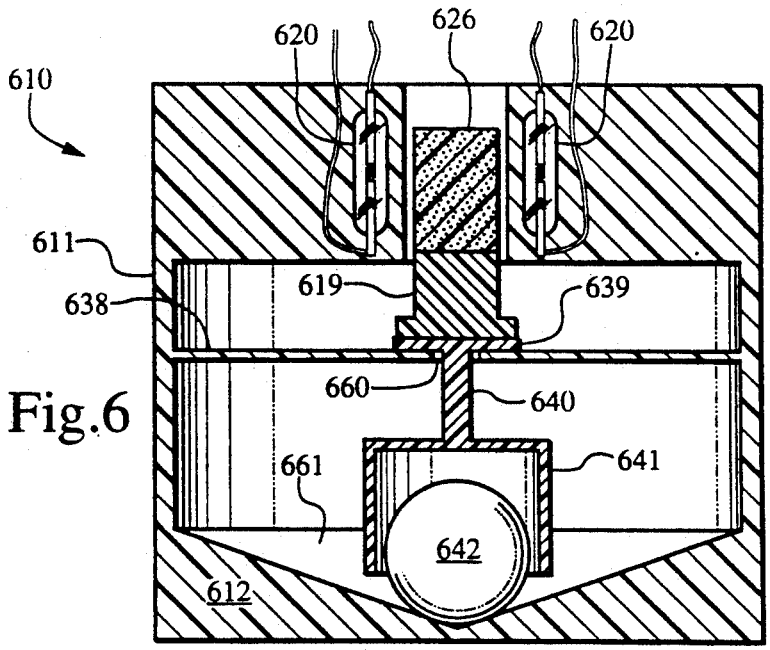

In the embodiment 610 of FIG. 6, a pair of reed switches 620 are secured in the walls of housing 611. Magnet 626 is secured to the upper end of a sub-frame member 619 which is supported on a platform 638 extending transversely across the interior of housing 611.

Sub-frame member 619 rests on a button 639 which is connected by means of a shaft 640 passing through an aperture 660 formed centrally in platform 638 to a gimbal cup 641 disposed within housing 611 below platform 638. Gimbal cup 641 has its open end lowermost, and substantially surrounds a weight in the form of ball 642. Ball 642 is free to roll on the base 612 of housing 611. Base 612 has inclined upper surfaces 661 meeting in a central depression. It will be apparent that, if ball 642 rolls on base 612 as a result of tilting of switch assembly 610 or as a result of an impulse applied to switch assembly 610, gimbal cup 641 will be displaced sideways causing pivoting of button 639 about its edge which remains in contact with platform 638. As a result of the shape of housing 611 in the vicinity of magnet 626, magnet 626 is constrained against lateral movement when button 639 pivots and the lateral motion of ball 642 is therefore translated into vertical movement of magnet 626 which actuates the reed switches 620. The inclined upper surface 661 of the base 612 prevents the ball 642 from escaping from gimbal cup 641. The inclined surface 661 also provides for automatic resetting of the switch 610 assembly when it is returned to an upright position.

Figure 7:
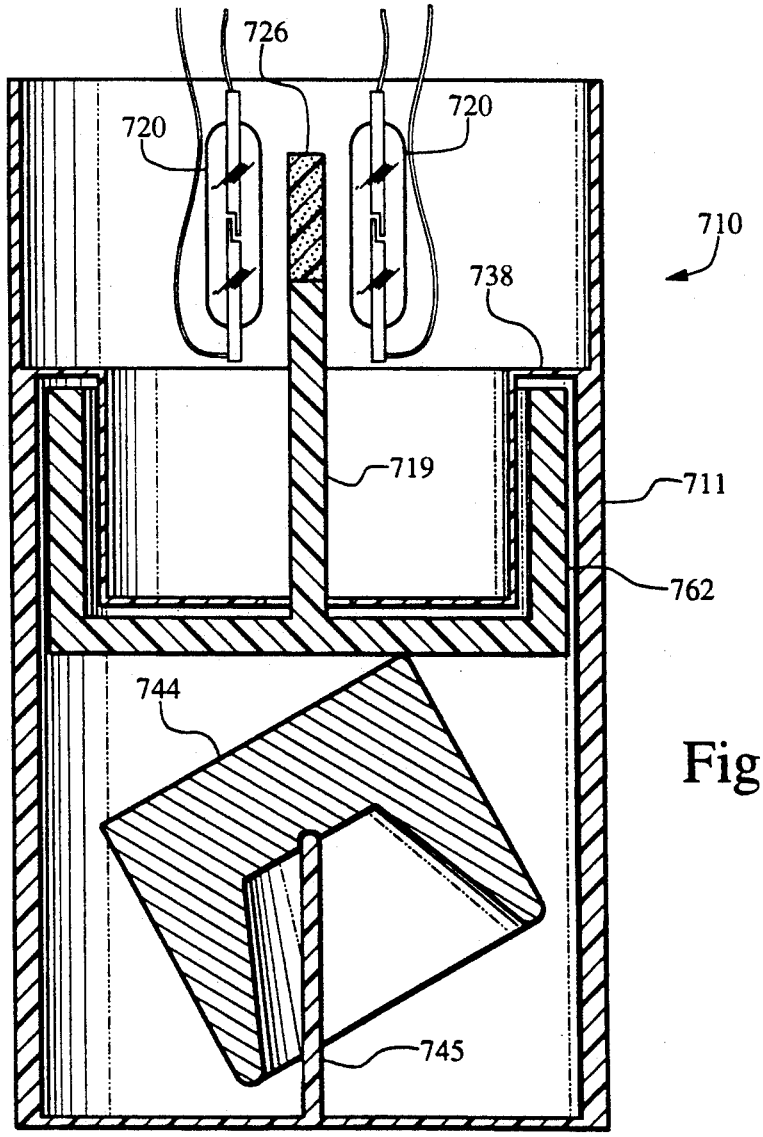
Figure 8:
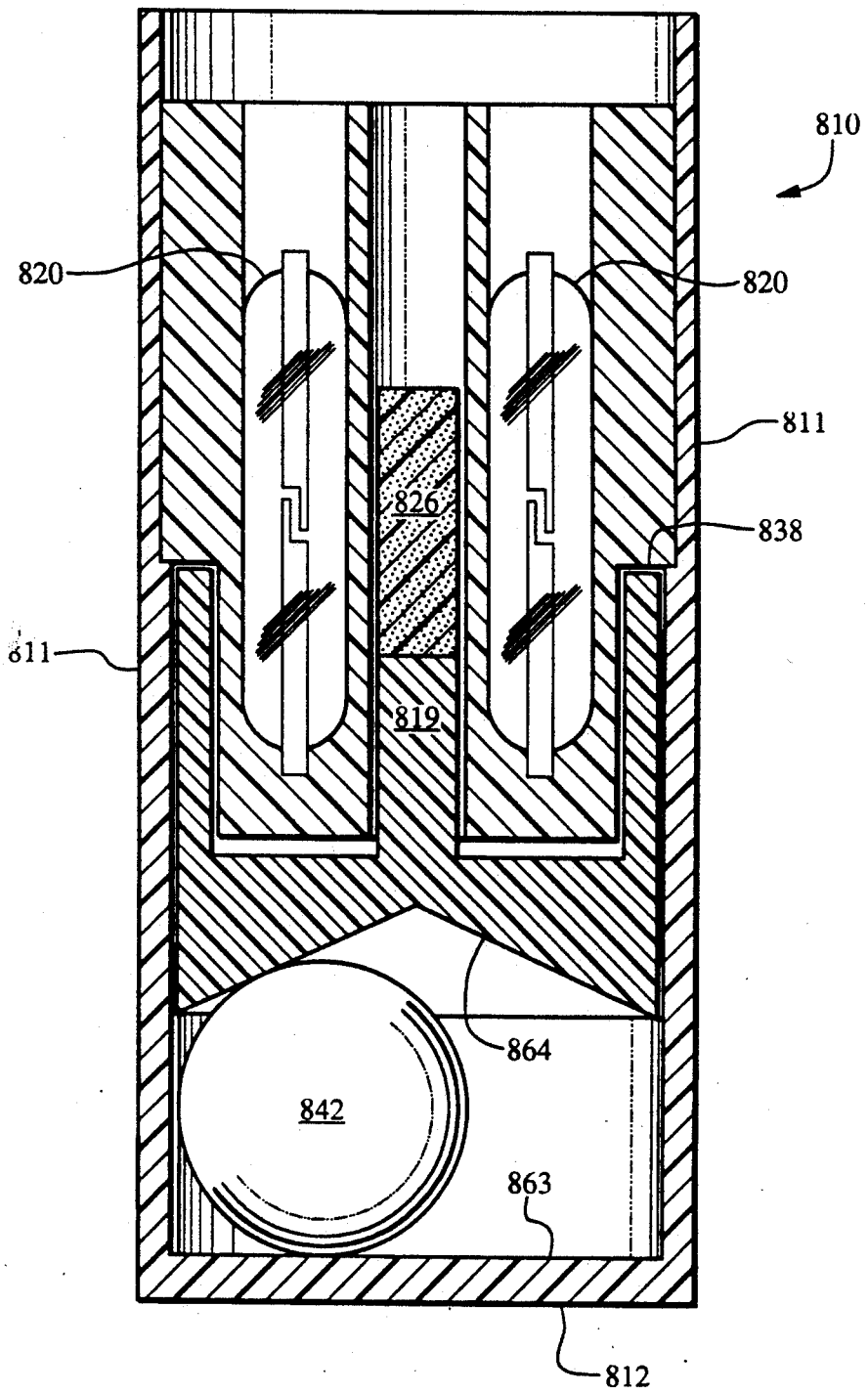

The embodiments 710, 810 of FIGS. 7 and 8 are similar to the embodiment 610 of FIG. 6 in that the magnet 726, 826 is secured at the top of a sub-frame member 719, 819 within housing 711, 811, the magnet 726, 826 being moved from below. In the case of FIG. 7, the weight, in the form of a yoke-like cup 744 is in contact with the lower edge of a flanged member 762 secured to the lower end of sub-frame member 719. Thus, when yoke 744 pivots about pivot member 745 the flange 762 and sub-frame member 719 tend to rise. The shape of a platform 738 secured across the interior of housing 711 constrains sub-frame member 719 to move generally only in a vertical direction to cause magnet 726 to actuate the reed switches 720.

In the embodiment 810 of FIG. 8, the arrangement is similar to that of FIG. 7 except that the weight is in the form of a ball 842 which is free to roll anywhere on the horizontal upper surface 863 of base 812 of housing 811. The lower surface 864 of sub-frame member 819 is formed as a conical impression. Therefore, rolling of ball 842 will tend to raise sub-frame member 819 and hence magnet 826. Magnet 826 thereby actuates reed switches 820. Movement of sub-frame member 819 and magnet 826 is constrained by the shape of platform 838 and the lower part of sub-frame member 819 to be generally vertical only.

Figure 9:
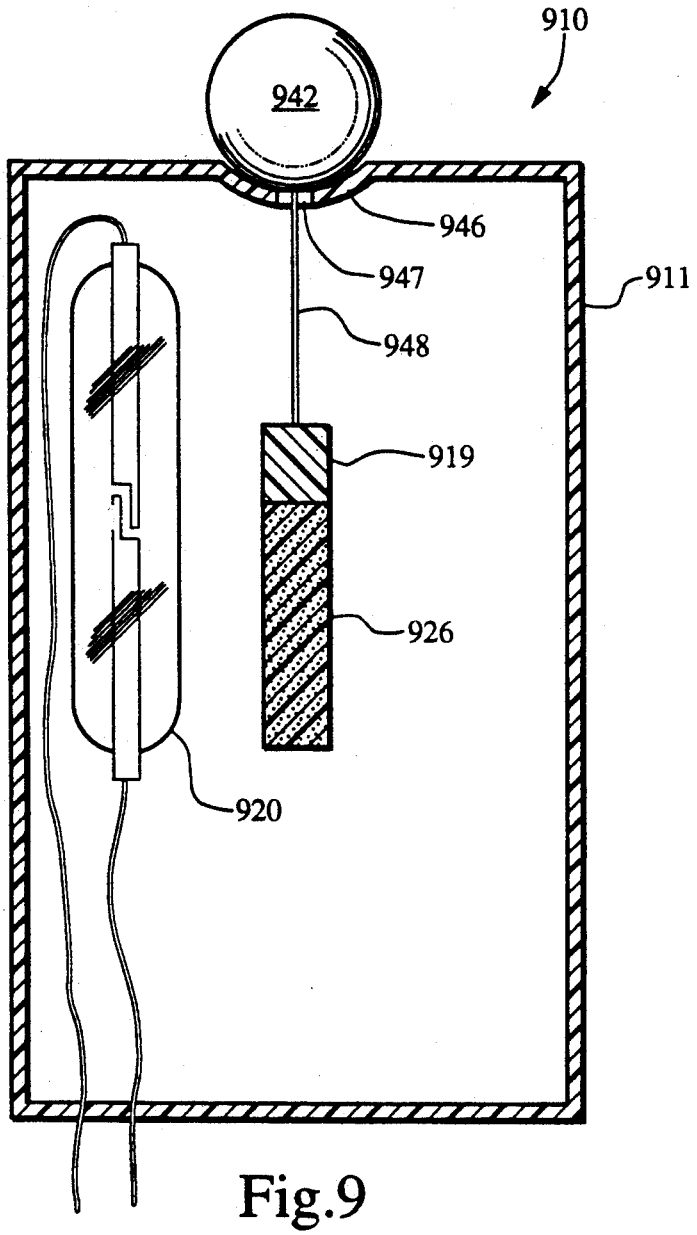

The embodiment 910 of FIG. 9 is one in which the weight is configured as a ball 942, which normally rests in a depression 946 formed in the external, upper surface of housing 911. An aperture 947 is formed centrally in depression 946, and a string, wire or other flexible member 948 secured to a sub-frame member 919 the lower end of which is secured to magnet 926. A reed switch 920 is secured within housing 911 adjacent magnet 926. When ball 942 rolls out of depression 946 laterally, by virtue of tilting of the switch assembly or by virtue of an impulse being applied to the switch assembly, magnet 926 is raised by tension in string, wire or other flexible member 948 and thereby reed switch 920 is actuated.

In all of the foregoing embodiments, whilst only a limited number of magnets and reed switches has been described, it will be appreciated that various configurations of magnets and reed switches can be devised. For example, versions of the embodiments can be produced in which a plurality of magnets surround a single reed switch; alternatively, a single magnet can be configured to operate a plurality of reed switches within the housing.

The housing and base can either be formed as a integral, one piece item or can be formed from separate components.

The material of the weight is typically brass, because brass is adequately dense to work in the embodiments of the invention without significantly effecting the magnetic field produced by the magnet.

It will be appreciated that the sensitivity of the switches can readily be adjusted, in a number of ways. The sensitivity is related to the stability of the weight. In those embodiments which employ a cup, the height of the cup, which dictates the overall height of the centre of mass of the tilting member, and the diameter of the cup can readily be adjusted to alter the sensitivity of the device.

Embodiments of the invention can be employed as float switches. However, in general, when so configured it is necessary to provide a return mechanism for the tilting member because the effects of gravity in returning the tilting member to its normal, upright position are significantly reduced.

The embodiments which employ a cup to translate lateral motion of the cup to vertical motion of the magnet produce a high mechanical advantage.

The current which the assemblies shown in the drawings can switch is limited by the rated current of the reed switches. It is possible to devise versions of the switch assemblies including integral solid state switching devices to handle high currents, with only small currents, within the rated capacities of the reed switches, being passed to the switch assemblies themselves.

All the embodiments shown can be configured to operate for tilts in any direction. They can also be configured without modification to operate as shock sensors, when coupled to appropriate shock sensing circuitry.

Although in the embodiments shown the source of magnetism has only been described as being a permanent magnet, other sources of magnetism are possible. For example, electromagnets may be used instead.

I claim:

1. A switch assembly responsive to an acceleration comprising:

a support;

a reed switch mounted in the support and having two blades;

a magnetic source movable between a first position which causes the blades of the reed switch to adopt one configuration and a second position which causes the blades to adopt a further configuration, wherein the support includes a hollow housing having a base, the reed switch extending upwardly of the base secured to a sub-frame within the housing, and the magnetic source being movable along the sub-frame;

an acceleration sensing weight movable under an acceleration in a direction generally perpendicular to the direction of movement of said magnetic source so that the weight moves in response to a shock or to tilting; and means for interconnecting the acceleration sensing weight and said magnetic source whereby movement of the weight relative to the support causes movement of the magnetic source between its two positions to actuate the reed switch, wherein the means for interconnecting comprises a hollow cup having a base, and further having an aperture formed in the base, the cup being disposed within the housing with its base of the cup, and the aperture surrounding the sub-frame, and wherein the weight is disposed about the upper end of the cup whereby lateral movement of the weight causes tilting of the cup which in turn raises the magnetic source up the sub-frame on the base of the cup to actuate the reed switch.

2. A switch assembly according to claim 1 wherein the base of the housing has formed therein a recess for receiving one end of the cup, the recess having upwardly extending walls which are outwardly inclined to permit tilting of the cup.

3. A switch assembly according to claim 1 wherein the weight is formed as a cap for the upper end of the cup.

4. A switch assembly according to claim 1 wherein the cup tapers towards the base thereof.

5. A switch assembly according to claim 1 wherein the weight is in the form of a cap mounted to the cup above the reed switch and the cap tapers towards an upper end thereof.

6. A switch assembly according to claim 1 wherein the magnetic source is a permanent magnet and wherein the magnet is spaced from the base of the cup by a spacer which transmits motion of the base of the cup to the magnet, whereby in the untilted condition of the cup the magnet lies adjacent the blades of the reed switch and when the cup tilts the magnet moves away from the blades to actuate the reed switch.

7. A switch assembly according to claim 1 wherein the upper end of the cup has a cap attached thereto, and the cap has formed therein an aperture through which extends at least part of the sub-frame.

8. A switch assembly responsive to an acceleration comprising:

a support;

a reed switch mounted in the support and having two blades;

a magnetic source movable between a first position which causes the blades of the reed switch to adopt one configuration and a second position which causes the blades to adopt a further configuration, wherein the support includes a hollow housing having a base, the reed switch extending upwardly of the base secured to a sub-frame within the housing, and the magnetic source being movable along the sub-frame;

an acceleration sensing weight movable under an acceleration in a direction generally perpendicular to the direction of movement of said magnetic source so that the weight moves in response to a shock or to tilting; and means for interconnecting the acceleration sensing weight and said magnetic source whereby movement of the weight relative to the support causes movement of the magnetic source between its two positions to actuate the reed switch, wherein the sub-frame has an upper end and wherein the weight is secured to a first member having a laterally extending foot flange which lies on the upper end of the sub-frame said member having an upwardly directed shaft having an upper end to which is secured the weight; and the means for interconnecting includes a second member having portions which extend downwardly about the sub-frame to support the magnetic source in the vicinity of the reed switch, the second member having portions defining an aperture through which extends the upwardly directed shaft whereby tilting of the first member causes raising of the foot flange which in turn raises the second member to move the magnetic source and thus actuate the reed switch.

9. A switch assembly responsive to an acceleration comprising:

a support;

a reed switch mounted in the support and having two blades;

a magnetic source movable between a first position which causes the blades of the reed switch to adopt one configuration and a second position which causes the blades to adopt a further configuration;

an acceleration sensing weight movable under an acceleration in a direction generally perpendicular to the direction of movement of said magnetic source so that the weight moves in response to a shock or to tilting;

means for interconnecting the acceleration sensing weight and said magnetic source whereby movement of the weight relative to the support causes movement of the magnetic source between its two positions to actuate the reed switch; and;

a cup having a base and at least one upwardly directed member extending upwardly from the cup base, the magnetic source being secured to the upwardly directed member and the weight acting on the base externally of the cup.

10. A switch assembly according to claim 9 wherein the support includes a base having an upwardly extending pivot member secured thereto, the pivot member being disposed between the base of the support and the base of the cup, the weight being pivotally mounted on the pivot member, whereby tilting of the weight on the pivot member causes the weight to drive the cup upwardly thereby actuating the reed switch.

11. A switch assembly according to claim 9 wherein the support includes a base and the weight is formed as a ball capable of rolling on said base, the cup having a downwardly facing, inclined face, the ball being disposed between the cup and the base of the support such that rolling of the ball on tilting of the switch assembly drives the cup upwards to move the magnet and actuate the reed switch, and means being provided to limit the movement of the cup in the direction of rolling of the ball.

12. A switch assembly responsive to an acceleration comprising:

a support;

a reed switch mounted in the support and having two blades;

a magnetic source movable between a first position which causes the blades of the reed switch to adopt one configuration and a second position which causes the blades to adopt a further configuration;

an acceleration sensing weight movable under an acceleration in a direction generally perpendicular to the direction of movement of said magnetic source so that the weight moves in response to a shock or to tilting; and means for interconnecting the acceleration sensing weight and said magnetic source whereby movement of the weight relative to the support causes movement of the magnetic source between its two positions to actuate the reed switch, wherein the support has a base with at least one upwardly facing inclined face, the weight being a ball constrained to roll on the inclined face, and wherein the means for interconnecting is formed as an inverted cup and surrounds the ball, the inverted cup including an upwardly extending member to which the magnetic source is connected, the arrangement being such that rolling of the ball on the inclined surface causes raising and lowering of the upwardly extending member, and thus the magnet, whereby the reed switch is actuated.

13. A switch assembly responsive to an acceleration comprising:

a support;

a reed switch mounted in the support and having two blades;

a magnetic source movable between a first position which causes the blades of the reed switch to adopt one configuration and a second position which causes the blades to adopt a further configuration;

an acceleration sensing weight movable under an acceleration in a direction generally perpendicular to the direction of movement of said magnetic source so that the weight moves in response to a shock or to tilting; and means for interconnecting the acceleration sensing weight and said magnetic source whereby movement of the weight relative to the support causes movement of the magnetic source between its two positions to actuate the reed switch, wherein the support includes a generally horizontal platform having portions defining an aperture therein, the reed switch being disposed below the platform, the weight being formed as a ball capable of rolling on the platform and the means for interconnecting being formed as an elongate, flexible member which passes through the aperture and which is secured at its ends to the weight and the magnetic source respectively.

14. A switch assembly of the type which responds to an accelerating force comprising:

(a) a support having a base;

(b) a sub-frame extending upward of the base;

(c) a reed switch mounted on the sub-frame having at least two blades;

(d) a magnet movable in a first direction between a first position which causes the blade of the reed switch to adopt one configuration and a second position which causes the blade to adopt a further configuration;

(e) an acceleration sensing weight movable in a second direction substantially different from the first direction, the weight being movable in response to an acceleration;

(f) a mechanical means for interconnecting the weight and the magnet whereby movement of the weight in the second direction causes movement of the magnet in the first direction between the first position and the second position, thus causing the blade of the reed switch to change configuration, wherein the means for interconnecting comprises a hollow cup, having a base and an upper end above the base, and further having an aperture formed in the base, the cup being positioned with its base adjacent to the base of the support, the magnet supported on the base of the cup, and the aperture surrounding the sub-frame, and wherein the weight is disposed about the upper end of the cup whereby movement of the weight in the second direction is substantially lateral and causes tilting of the cup which in turn moves the magnet in the first direction which is substantially upward from the support along the upwardly extending sub-frame mounted on the base, the upward movement of the magnet from the first position to the second position causing the blade to adopt a further configuration.

15. The switch assembly of claim 14 wherein the support includes a hollow housing extending upward of the base and surrounding the sub-frame.

16. The switch assembly of claim 15 wherein the housing has a base with portions defining a recess therein for receiving one end of the cup, the recess having upwardly extending walls which are outwardly inclined to permit tilting of the cup.

17. The switch assembly of claim 14 wherein the weight is formed as a cap mounted on the upper end of the cup.

18. The switch assembly of claim 14 wherein the cup tapers towards the cup base.

19. The switch assembly of claim 14 wherein the cup tapers towards the upper end of the cup.

20. The switch assembly of claim 14 wherein the magnet is spaced from the base of the cup by a spacer which transmits motion of the base of the cup to the magnet, whereby in the untilted position of the cup the magnet lies adjacent to a blade of the reed switch and when the cup tilts the magnet moves away from the blade causing the blade to adopt a further configuration.

21. The switch assembly of claim 14 wherein the upper end of the cup has formed therein an aperture through which extends at least a part of the sub-frame on which is mounted the reed switch.

* * * * *